US006632396B1

(12) United States Patent
Tetjukhin et al.

(10) Patent No.: US 6,632,396 B1
(45) Date of Patent: Oct. 14, 2003

(54) TITANIUM-BASED ALLOY

(76) Inventors: Vladislav Valentinovich Tetjukhin, 1 Botkinsky proezd, 2-6-9, Moscow (RU), 125284; Jurv Ivanovich Zakharov, ul. Petrozavodskava, 5-2-284, Moscow (RU), 125502; Igor Vasilievich Levin, ul. Engelsa, 29-4, Verkhnyaya Salda, Sverdloyskaya obl. 624600 (RU)

( * ) Notice: Subject to any disclaimer, the term of this patent is extended or adjusted under 35 U.S.C. 154(b) by 0 days.

(21) Appl. No.: 09/937,867

(22) PCT Filed: Apr. 3, 2000

(86) PCT No.: PCT/RU00/00113

§ 371 (c)(1),
(2), (4) Date: Sep. 13, 2001

(87) PCT Pub. No.: WO00/63451

PCT Pub. Date: Oct. 26, 2000

(30) Foreign Application Priority Data

Apr. 20, 1999 (RU) ..... 99108488

(51) Int. Cl.[7] ..... C22C 14/00

(52) U.S. Cl. ..... 420/420; 420/417; 420/418; 420/421; 148/421

(58) Field of Search ..... 420/417, 418, 420/419, 420, 421; 148/421

(56) References Cited

U.S. PATENT DOCUMENTS 4,889,170 A * 12/1989 Mae et al. ..... 148/407

5,358,686 A * 10/1994 Parris et al. ..... 148/421

FOREIGN PATENT DOCUMENTS

| | | |
|---|---|---|
| RU | 555161 | 5/1977 |
| RU | 2082803 | 6/1997 |

OTHER PUBLICATIONS

Derwent Patent Abstract of RU 1132567 C, Khorev, Russian Patent Derwent No. 1995–168103.*

Derwent Patent Abstract of SU 555161 A, Glazunov, U.S.S.R Patent Derwent No. 1978–19188 A.*

Derwent Patent Abstract of RU 2082802 C1, Khorev et al., Russian Patent Derwent No. 1998–050637.*

* cited by examiner

*Primary Examiner*—Roy King
*Assistant Examiner*—Andrew Wessman
(74) *Attorney, Agent, or Firm*—David L. Garrison; Garrison & Assoc. PS

(57) ABSTRACT

Titanium-based alloy contains, % by mass: aluminum 2.2 to 3.8; vanadium 4.5 to 5.9; moloybdenum 4.5 to 5.9; chromium 2.0 to 3.6; iron 0.2 to 0.8; zirconium 0.0l to 0.08; carbon 0.01 to 0.25; oxygen 0.03 to 0.25; titanium being the balance. The alloy possesses high ability to volume deformation in cold state (is easily rolled into rods), does not have tendency to form high-melting inclusions and is efficiently enforced with thermal treatment with obtaining of high level of strength and plasticity characteristics.

4 Claims, No Drawings

TITANIUM-BASED ALLOY

FIELD OF INVENTION

The invention relates to metallurgy, and more particularly, to titanium-based alloys intended for production of rods, fasteners and other parts for aeronautical engineering.

BACKGROUND OF THE INVENTION

Titanium-based alloy of the following composition, % by weight: aluminum 2–6; molybdenum 69; vanadium 1–3; chromium 0.5–2.0; iron 0–1.5; titanium being the balance is known (USSR Inventor's certificate #180351, C22C 14/00, 1966).

The above said alloy was suggested for production of forgings and stampings applicable to highly stressed structural parts. Significant disadvantage of the said alloy is its tendency to formation of high-melting inclusions in the process of ingot casting due to high content of such high-melting element as molybdenum (>6%). Occurrence of such inclusions in highly stressed elements leads to destruction of these parts in operation.

The most close to the proposed alloy in terms of its technical essence is titanium-based alloy of the following composition, % by weight:aluminum 4.0–6.3; vanadium 4.0–5.0; molybdenum 1.5–2.5; chromium 0.8–1.4; iron 0.4–0.8; zirconium 0.01–0.08; carbon 0.01–0.25; oxygen 0.03–0.25; titanium being the balance (USSR Inventor's Certificate #555161, C22C 14/00, 1977).

This alloy possesses high strength characteristics, good level of plasticity, it can be easily rolled into rod and sheet, it is good welded and does not show tendency to form high-melting inclusions. Among drawbacks of this alloy impossibility of its cold volume stamping due to insufficient level of such indicator of technological plasticity in hardened condition as degree of cold upsetting (<60%) should be mentioned.

Besides, on this alloy in the process of thermal enforcement high level of strength ($\sigma_B \geqq 1400$ Mpa) can be reached only with small cross-sections, up to 25 mm.

SUMMARY

An object of the present invention is to increase the alloy ability to cold volume deforming (upsetting degree ≧75%), and to attain possibility of thermal enforcement to the high level of strength ($\sigma_B \geqq 1400$ Mpa).

Solution of the problem is ensured by titanium-based alloy containing aluminum, vanadium, molybdenum, chromium, iron, zirconium, carbon, oxygen, wherein according to the invention components are contained in the following proportion, % by mass:

| | |
|---|---|
| Aluminum | 2.2–3.8 |
| Vanadium | 4.5–5.9 |
| Molybdenum | 4.5–5.9 |
| Chromium | 2.0–3.6 |
| Iron | 0.2–0.8 |
| Zirconium | 0.01–0.08 |
| Carbon | 0.01–0.25 |
| Oxygen | 0.03–0.25 |
| Titanium | the balance |

Regulation of aluminum and chromium content in the claimed alloy composition ensures high ability of the alloy to volume deforming in cold condition (it is easily rolled into rods), absence of tendency to high-melting inclusion formation and possibility of the alloy enforcement by thermal methods with obtaining sufficient level of strength and plasticity characteristics.

When aluminum and chromium contents are lower than minimal values of the claimed range the alloys strength after thermal enforcement decreases ($\sigma_B$<1400 Mpa), i.e. the preset object is not attained.

When aluminum and chromium contents are higher than the maximal claimed limit plasticity of the alloy drops ($\delta$<8%, $\psi$<40%) at the high level of strength ($\sigma_B \geqq 1400$ Mpa).

BEST MODE OF CARRYING OUT THE INVENTION

To study the alloy characteristics ingots of the claimed composition, % by mass; were melted out in a vacuum arc furnace by the double remelting method:

| Example 1 | | Example 2 | | Example 3 | |
|---|---|---|---|---|---|
| Al | 2.2 | Al | 3.0 | Al | 3.8 |
| V | 4.5 | V | 5.2 | V | 5.9 |
| Mo | 4.5 | Mo | 4.8 | M | 5.9 |
| Cr | 2.0 | Cr | 2.8 | Cr | 3.6 |
| Fe | 0.2 | Fe | 0.6 | Fe | 0.8 |
| Zr | 0.01 | Zr | 0.04 | Zr | 0.08 |
| C | 0.01 | C | 0.2 | C | 0.25 |
| O | 0.03 | O | 0.2 | O | 0.25 |
| Ti | the balance | Ti | the balance | Ti | the balance |

Rods of 50 mm diameter were made out of each ingot. The rods were subjected to thermal to high strength. Mechanical properties of rods are given in the table.

| | | Mechanical properties | | | | |
|---|---|---|---|---|---|---|
| Alloy (examples) | Deformation degree in cold resetting E, % | ultimate strength $\sigma_B$ (Mpa) | yield strength $\sigma_{0.2}$ (Mpa) | elongation $\delta$ (%) | reduction of area $\psi$ (%) | shear strength $\tau_{cp}$ (Mpa) |
| 1 | 80 | 1420 | 1360 | 12 | 50 | 920 |
| 2 | 78 | 1460 | 1380 | 10 | 45 | 950 |
| 3 | 75 | 1510 | 1450 | 9 | 42 | 980 |
| Needed level of properties | 75 | 1400 | 1300 | 8 | 40 | 900 |

The test results show that articles (50 mm diameter rods) of the claimed titanium-based alloy possess high level of technological plasticity in hardened state, at the same time degree of cold resetting ≦80% is attained together with high strength characteristics obtained after aging.

COMMERCIAL PRACTICABILITY

The claimed titanium-based alloy is intended for production of parts for aeronautical engineering, for instance, holders.

These, and other modifications to the preferred embodiment would be obvious to one of ordinary skill. Therefore, it is intended that the foregoing detailed description be regarded as illustrative, rather than limiting, and that it be understood that it is the following claims, including all equivalents, which are intended to define the protected scope of this invention.

We claim:

1. Titanium-based alloy having a combination of a high ability to cold volume deform, exceeding 75% and $\sigma_\beta$ strength exceeding 1400 Mpa, said alloy containing aluminum, vanadium, molybdenum, chromium, iron, zirconium, carbon and oxygen, which distinction is that the alloying components are taken in the following proportion, % by mass:

| | |
|---|---|
| Aluminum | 2.2–3.8 |
| Vanadium | 4.5–5.9 |
| Molybdenum | 4.5–5.9 |
| Chromium | 2.0–3.6 |
| Iron | 0.2–0.8 |
| Zirconium | 0.01–0.08 |
| Carbon | 0.01–0.25 |
| Oxygen | 0.03–0.25 |
| Titanium | the balance. |

2. A titanium-based alloy according to claim 1 wherein said alloy contains aluminum, vanadium, molybdenum, chromium, iron, zirconium, carbon and oxygen the follow approximate proportions, % by mass

| | |
|---|---|
| Al | 2.2 |
| V | 4.5 |
| Mo | 4.5 |
| Cr | 2.0 |
| Fe | 0.2 |
| Zr | 0.01 |
| C | 0.01 |
| O | 0.03 |
| Ti | the balance. |

3. A titanium-based alloy according to claim 1 wherein said alloy contains aluminum, vanadium, molybdenum, chromium, iron, zirconium, carbon and oxygen the follow approximate proportions, % by mass

| | |
|---|---|
| Al | 3.0 |
| V | 5.2 |
| Mo | 4.8 |
| Cr | 2.8 |
| Fe | 0.6 |
| Zr | 0.04 |
| C | 0.2 |
| O | 0.2 |
| Ti | the balance. |

4. A titanium-based alloy according to claim 1 wherein said alloy contains aluminum, vanadium, molybdenum, chromium, iron, zirconium, carbon and oxygen the follow approximate proportions, % by mass

| | |
|---|---|
| Al | 3.8 |
| V | 5.9 |
| Mo | 5.9 |
| Cr | 3.6 |
| Fe | 0.8 |
| Zr | 0.08 |
| C | 0.25 |
| O | 0.25 |
| Ti | the balance. |

* * * * *